US005894263A

United States Patent [19]

Shimakawa et al.

[11] Patent Number: 5,894,263

[45] Date of Patent: Apr. 13, 1999

[54] VIBRATION GENERATING APPARATUS

[75] Inventors: Shinichi Shimakawa, Katano; Noriyuki Fujiwara, Ibaraki; Masaru Nagaike, Hirakata; Shinichiro Inukai, Yokohama; Takao Matsunami, Hirakata, all of Japan

[73] Assignee: Matsushita Electric Industrial Co., Ltd., Japan

[21] Appl. No.: 08/764,504

[22] Filed: Dec. 12, 1996

[30] Foreign Application Priority Data

Dec. 15, 1995 [JP] Japan ..... 7-327536
Oct. 14, 1996 [JP] Japan ..... 8-270929

[51] Int. Cl.[6] ..... G08B 3/00

[52] U.S. Cl. ..... 340/388.1; 340/384.1; 340/311.1; 340/407.1; 340/825.44; 340/825.46; 381/192; 381/194; 381/199

[58] Field of Search ..... 340/388.1, 388.5, 340/388.6, 384.1, 311.1, 407.1, 825.44, 825.46; 381/192, 194, 199, 200, 205, 151, 158

[56] References Cited

U.S. PATENT DOCUMENTS 4,720,868 1/1988 Hirano ..... 381/182
4,750,208 6/1988 Yamada et al. ..... 381/151
4,843,628 6/1989 Hofer ..... 381/151
4,931,765 6/1990 Rollins et al. ..... 340/407
5,107,540 4/1992 Mooney et al. ..... 381/192
5,125,033 6/1992 Lee ..... 381/151
5,166,984 11/1992 Hsiao ..... 381/192
5,172,092 12/1992 Nguyen et al. ..... 340/311.1
5,181,253 1/1993 Jordan ..... 381/199
5,321,763 6/1994 Lee ..... 381/192
5,475,765 12/1995 Lyth ..... 381/188
5,528,697 6/1996 Saito ..... 340/311.1

*Primary Examiner*—Nina Tong
*Attorney, Agent, or Firm*—Parkhurst & Wendel

[57] ABSTRACT

The present invention has an object to provide a method for generating vibration and a vibration generating apparatus for allowing a single unit to provide a call signal by way of sound and body-sensible vibration. According to the method for generating vibration of the invention, first and second vibration systems having different resonance frequencies from each other are magnetically coupled to each other and a state of energy externally supplied to the systems is selected thereby causing the first vibration system to vibrate relative to the second vibration system for generating a body-sensible vibration, for example. By changing the state of the energy, the second vibration system is caused to vibrate relative to the first vibration system for generating sound.

4 Claims, 17 Drawing Sheets

VIBRATION GENERATING APPARATUS

TECHNICAL FIELD

The present invention relates to a vibration generating apparatus for message communications which is employed by portable pagers or miniature message communicating apparatuses and more particularly, to a vibration generating apparatus adapted to produce an audible beeping signal or otherwise a body-sensible vibration for messaging.

BACKGROUND ART

Conventionally, the pager is adapted to produce an audible beeping signal for informing a pager carrier of a phone call when an internal receiver thereof receives a radio call signal. Unfortunately, the audible beeping signal may annoy people around the aforesaid carrier or make it known that the carrier is wanted on the phone.

To eliminate such inconveniences, the current pager is provided with a function for informing the carrier of a phone call by generating a body-sensible vibration additionally to an audible beeping signal and is adapted to allow the carrier to select a call signal by way of sound or vibration.

As shown in FIG. 16, a casing 1 of the pager houses therein a speaker, and a pager motor 3 separate from the speaker 2. The pager motor 3 responsive to a radio call signal to generate vibrations of a degree to be sensed by the human body comprises a cylindrical coreless motor 4 and a weight 6 formed of an alloy of a high specific gravity, such as tungsten, and mounted to a rotating shaft 5 of the coreless motor 4, as seen in FIG. 17. $IC_1$ and $IC_2$ of FIG. 16 denote semiconductor integrated circuits, respectively.

The weight 6 is shaped like a semicircle or sector. When the coreless motor 4 is energized, the eccentrically mounted weight 6 rotates so as to indirectly generate vibrations in the casing 1 of the pager. The casing 1 of the pager is formed with sound emanating apertures 7 correspondingly to a position where the speaker 2 is mounted.

DISCLOSURE OF THE INVENTION

Such a conventional construction has the following disadvantages in downsizing portable devices such as a pager and the like.

1. In the construction wherein the eccentric weight is attached to the cylindrical coreless motor, a heavy load is applied to the rotating shaft. Accordingly, it is impossible to fully satisfy the need for further downsizing or prolonged service life of the apparatus. Furthermore, the construction is disadvantageous in that the eccentric weight is apt to slip off from the rotating shaft. This requires enormous time for assembly work in order to maintain the product quality.

2. The conventional construction requires the pager motor 3 additionally to the speaker 2 for generating the audible beeping signal. This makes it difficult to reduce the number of components of the device.

It is therefore, an object of the present invention to provide a method for generating vibration and a vibration generating apparatus for allowing a single unit to provide a call signal by way of sound as well as body-sensible vibration.

A method for generating vibration applicable to a portable device capable of selectively generating sound and body-sensible vibration, characterized in that a first vibration system and a second vibration system having different resonance frequencies from each other are magnetically coupled to each other, and that an energy is externally supplied to the magnetically coupled systems to thereby selectively switch between a first state wherein the first vibration system is caused to vibrate relative to the second vibration system and a second state wherein the second vibration system is caused to vibrate relative to the first vibration system. By selecting a state of energy externally supplied to a single unit, the first vibration system is caused to vibrate for generating a body-sensible vibration, for example. On the other hand, by changing the state of the energy, the second vibration system is caused to vibrate for generating a sound.

A vibration generating apparatus of the invention comprises a pair of plate-like resilient bodies opposing each other within a frame body, one of the plate-like resilient bodies being provided with a magnetic field generating element having a magnet so as to form a first vibration system, the other plate-like resilient body being provided with a coil magnetically coupled to a magnetic field generated in the magnetic field generating element so as to form a second vibration system, which apparatus is characterized in that one of the aforesaid first and second vibration systems has a higher resonance frequency than that of the other vibration system, and that the first or the second vibration system is selectively brought into vibration in correspondence to a frequency of an exciting current supplied to the aforesaid coil.

In this arrangement, the first vibration system is brought into vibration correspondingly to a frequency of the exciting current supplied to the coil, thereby generating a body-sensible vibration. On the other hand, the frequency of the exciting current supplied to the coil is changed to bring the second vibration system into vibration for generating a sound.

More preferably, the plate-like resilient body constituting the first vibration system is adapted to vibrate in the direction of the center line of the frame body and a soft resilient body is provided on the inner circumferential surface of the frame body as spaced from the outer peripheral portion of the yoke. This prevents the occurrence of abnormal sound caused by the yoke coming into contact with the soft resilient body attached to the inner circumferential surface of the frame body, regardless of the orientation of the main body of the apparatus or even if the apparatus is subject to a drop impact or the like.

More preferably, there is provided a direction restricting member for restricting the plate-like resilient body to vibration in the direction of the center line of the frame body, the plate-like resilient body constituting the first vibration system. This prevents the self-oscillation of the yoke and restricts the yoke to the vibration in the direction of the center line of the frame body regardless of the orientation of the main body of the apparatus or even if the apparatus is subject to a drop impact. Thus, the yoke is prevented from coming into contact with the inner circumferential surface of the frame body, whereby the occurrence of abnormal sound is avoided.

More specifically, the vibration generating apparatus of the invention has an arrangement such that the first vibration system comprises one of the plate-like resilient bodies and the magnetic field generating element including the yoke and magnet and attached to the plate-like resilient body, the second vibration system comprises the coil attached to the other plate-like resilient body and magnetically coupled to the interior peripheral portion of the yoke, and the soft resilient body is provided on the inner circumferential surface of the frame body as spaced from the outer peripheral portion of the yoke.

More specifically, a guide shaft extending through the center of the yoke is provided as the aforesaid direction restricting member.

As another specific example of the direction restricting member has an arrangement such that the first vibration system comprises one of the plate-like resilient bodies and the magnetic field generating element including the yoke and magnet and attached to the plate-like resilient body, the direction restricting member is provided for restricting the vibration of the yoke to the direction along the center line of the frame body and a pair of plate-like resilient supports as the direction restricting member are provided for carrying the top and bottom surfaces of the outer peripheral portion of the yoke on the frame body, respectively.

More preferably, a resonance frequency of the first vibration system is 250 Hz or less, whereas a resonance frequency of the second vibration system is 600 Hz or more.

More specifically, the magnetically coupled state of the first and second vibration systems is established by an arrangement wherein the first vibration system comprises the yoke attached to one of the plate-like resilient bodies and having the central and outer peripheral portion thereof projecting toward the other plate-like resilient body, and the magnet disposed on the inner side of the outer peripheral portion of the yoke, and the second vibration system comprises the cylindrical coil attached the other plate-like resilient body and projecting toward the aforesaid plate-like resilient body, the coil being positioned between the inner peripheral side of the magnet and the outer peripheral side of the central portion of the yoke.

More specifically, it is preferred that the plate-like resilient body of the first vibration system is formed of a hat-shaped metal resilient body including a top surface, a bottom surface and a connecting portion interconnecting the top and bottom surfaces.

More specifically, the plate-like resilient body of the second vibration system includes an annular groove, to which the coil is fixed for positioning the coil on the plate-like resilient body of the second vibration system, the coil being magnetically coupled to the magnetic field generated in the magnetic field generating element of the first vibration system.

Such a vibration generating apparatus of the invention is preferably incorporated in the portable devices such as pagers or the like because such an apparatus can realize a lightweight portable device capable of switching between two kinds of call signals including beeps and body-sensible vibration. Furthermore, such a portable device is free from abnormal sound regardless of the orientation of the device or even if the device is subject to a drop impact.

DESCRIPTION OF EMBODIMENTS

Now, modes of carrying out the present invention will herein be described with reference to FIGS. 1 through 15.

First Mode of the Invention

Figure 1:
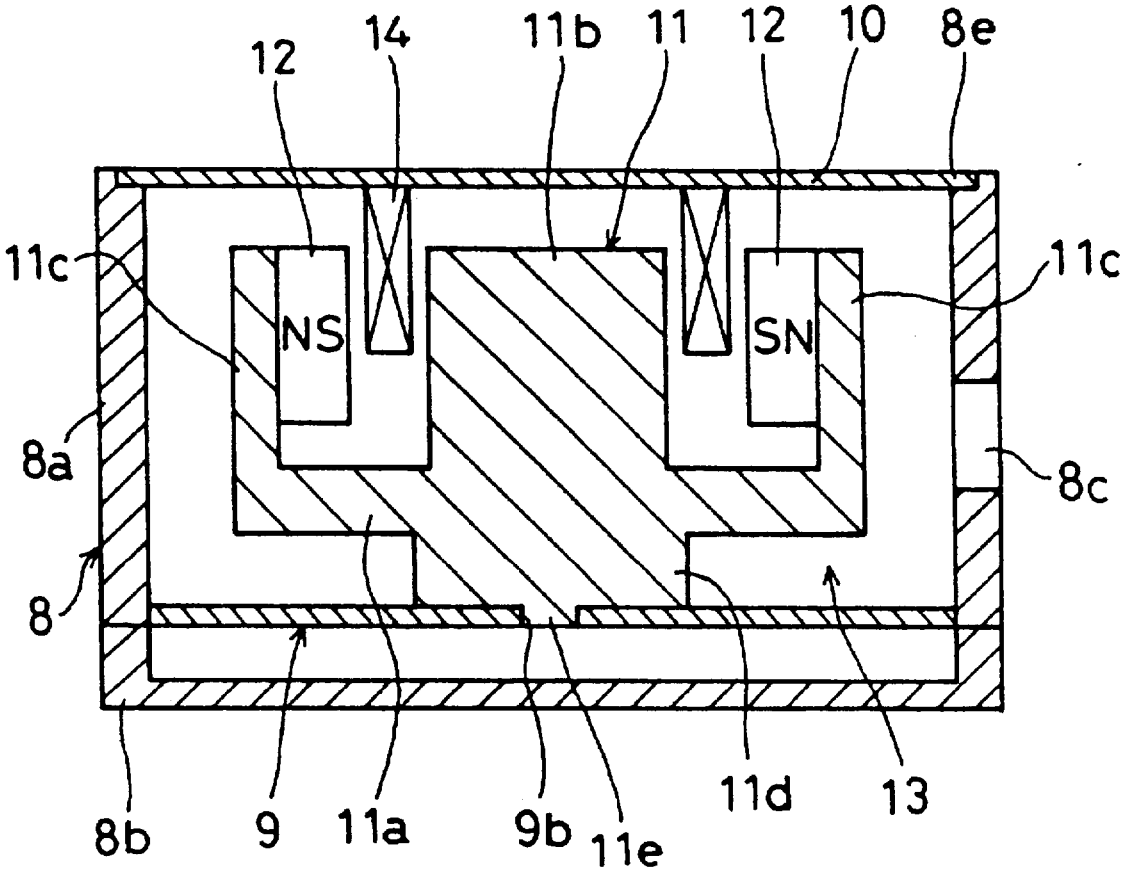
FIG. 1 is a sectional view of a vibration generating apparatus according to the present invention (first mode hereof)
Figure 2:
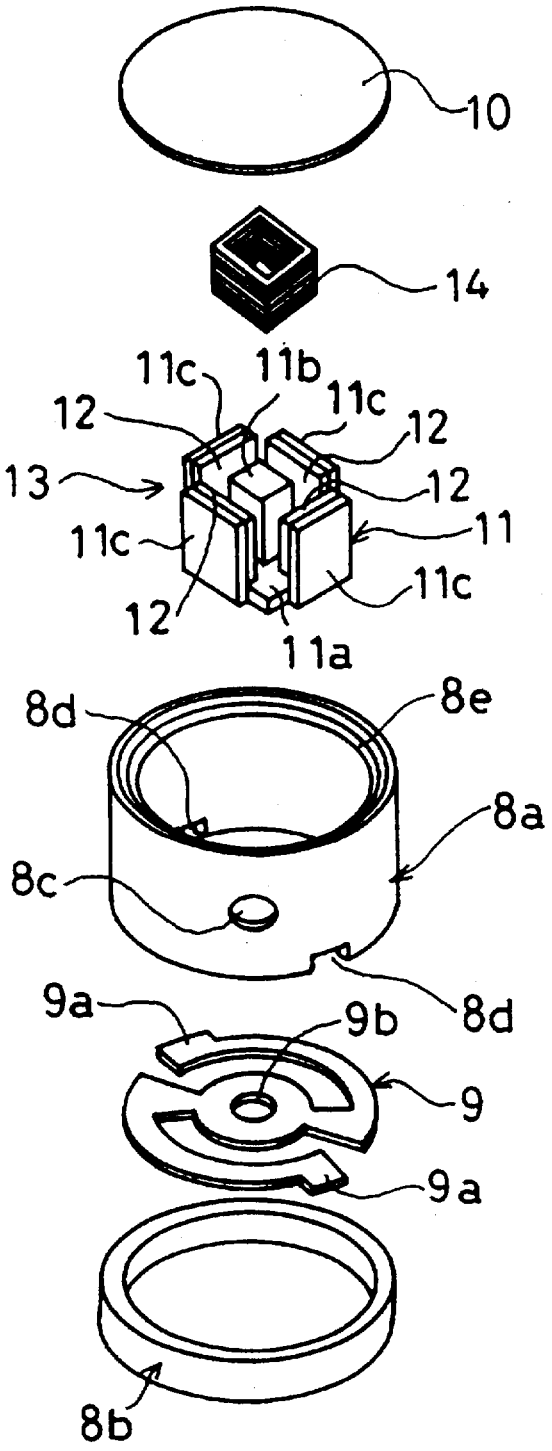
FIG. 2 is an exploded perspective view of the above mode.
Figure 3:
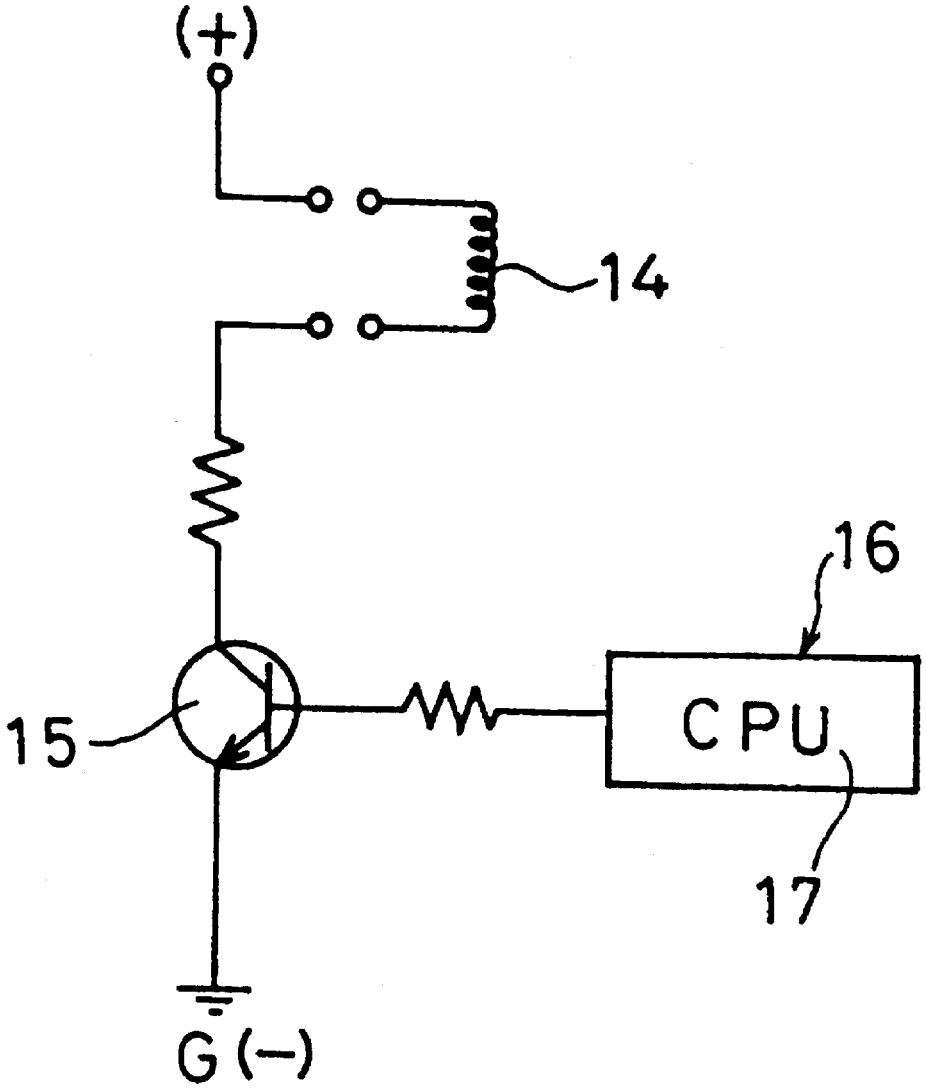
FIG. 3 is a diagram of an electric circuit for driving the vibration generating apparatus of the above mode.

FIGS. 1 through 3 illustrate a vibration generating apparatus of a first mode hereof.

A cylindrical frame body 8 includes an upper cylinder body 8*a* and a lower cylinder body 8*b*. The upper cylinder body 8*a* includes at the lower end thereof a pair of opposite recesses 8*d* for fittedly receiving projections 9*a* of a first plate-like resilient body 9. The upper cylinder body 8*a* is formed with an annular step 8*e* at the upper end thereof for fittedly supporting a second plate-like resilient body 10. The upper cylinder body 8*a* is formed with a resonance aperture 8*c* in the outer circumferential surface thereof for an effect of resounding an audible beeping signal.

The lower cylinder body 8*b* is shaped like a cylinder with bottom which is smaller in height than the upper cylinder body 8*a*. The top surface of the lower cylinder body 8*b* cooperates with the recesses 8*d* of the upper cylinder body 8*a* to hold the projections 9*a* of the first plate-like resilient body 9 therebetween. The lower cylinder body 8*b* not only serves to support the first plate-like resilient body 9 but also prevents the vibration of the first plate-like resilient body 9 from being hindered by some other obstacle with which the first plate-like resilient body 9 comes into contact.

Incidentally, it is preferable to form the upper and lower cylinder bodies 8*a* and 8*b* of a resin or metal material.

The first plate-like resilient body 9 has a magnetic field generating element 13 attached thereto, the magnetic field generating element comprising a yoke 11 and a plate-like magnet 12. More specifically, as shown in FIG. 2, the yoke 11 is disposed at the center of the top surface of the first plate-like resilient body 9 and has a construction comprising a base portion 11*a* of a square plate, outer peripheral portions 11*c* extending upward from the respective four sides of the base portion 11*a*, a center pole 11*b* upstanding from the center of the base portion 11*a* and having a planar form of square, and a leg 11*d*, not shown in FIG. 2, having a horizontal sectional form of circle and extending downward from the center of the base portion 11*a* as shown in FIG. 1. Formed at the center of the lower surface of the leg 11*d* is a projection 11*e* fitted in a mounting hole 9*b* defined at the center of the first plate-like resilient body 9. The fitting engagement between the mounting hole 9*b* and the projection 11*e* facilitates the positioning of the yoke 11 on the first plate-like resilient body 9, thus contributing to an enhanced productivity.

The magnet 12 is attached to the outer peripheral portion 11*c* of the yoke 11 in such a manner that the N-pole side of the magnet 12 contacts the inner surface of the outer peripheral portion 11*c* of the yoke 11 and the S-pole side thereof face the outer circumference of the center pole 11*b* of the yoke 11, as spaced therefrom. The magnet 12 is attached to the outer peripheral portion 11*c* in such a manner that the lower end thereof does not contact the base portion 11*a*, as spaced therefrom. It is preferred that the yoke 11 is formed of a soft magnetic material such as pure iron or the like and the magnet 12 is formed of, for example, a rare earth type magnet material.

The second plate-like resilient body 10 is fitted in the step 8*e* defined in the upper end of the upper cylinder body 8*a* as opposing the first plate-like resilient body 9 and has a coil 14 attached thereto. As shown in FIG. 1, the coil 14 is inserted into a magnetic gap between the center pole 11*b* of the yoke 11 and the magnets 12 attached to the respective outer peripheral portions 11*c* of the yoke 11 for establishing a magnetic coupling relation.

More specifically, the coil 14 is formed of an enamel wire prepared by baking a resin material on the surface of a copper wire, having a substantially square shape as seen in top view and a size to be allowed into space between the inner peripheral sides of the magnets 12 and the outer circumferential side of the center pole lib of the yoke 11. The coil 14 extends downward from the center of the bottom surface of the second plate-like resilient body 10 so as to be positioned at place of a higher density of magnetic flux in the magnetic field of the magnetic field generating element 13 comprising the yoke 11 and the magnets 12.

In this manner, the first plate-like resilient body 9 and the magnetic field generating element 13 constitute a first vibration system whereas the second plate-like resilient body 10 and the coil 14 constitute a second vibration system. The first plate-like resilient body 9 is formed of a metal sheet such as a steel sheet and shaped like a letter "S". The first plate-like resilient body 9 has a smaller spring constant than the second plate-like resilient body 10.

Although a vibration generating apparatus of the invention can attain a sufficient effect by forming the first and second plate-like resilient bodies 9 and 10 in the identical shape, the aforementioned construction provides for an even lower resonance frequency of the first vibration system to thereby accomplish an even more distinct frequency difference between the first and the second vibration systems.

The second plate-like resilient body 10 is shaped like a disc formed of a metal sheet such as a steel sheet. The second plate-like resilient body 10 has a greater spring constant than the first plate-like resilient body 9 so that the second vibration system exhibits a higher resonance frequency in contrast to the first vibration system.

As shown in FIG. 3, a transistor 15 is interposed in series with an exciting circuit of the coil 14 of the vibration generating apparatus thus constructed. The transistor is switchable by means of an oscillation circuit 16 operable to switch drive signals.

The oscillation circuit 16 principally comprises CPU 17. The transistor 15 is supplied with pulse signals alternating between close and open of the circuit. A current of the same frequency with that of the pulse signal flows through the coil 14. When the coil 14 is energized, the yoke 11 with the magnets 12 and the coil 14 are brought into vibration by an electromagnetic force, resulting in the vibration of the first and second vibration systems. Incidentally, the CPU 17 is adapted to select a first frequency for bringing the first vibration system into resonance and a second frequency for bringing the second vibration system into resonance.

The CPU 17 applies a pulse signal of 100 Hz, for example, to the transistor 15 according to a resonance frequency of the first vibration system so that the vibration generating apparatus itself produces resonance in synchronism with the aforesaid resonance frequency to thereby generate a body-sensible vibration. This provides an inaudible signal indicative of a phone call which does not entail annoyance on other people.

On the other hand, the CPU 17 applies a pulse signal of 2.7 KHz to the transistor 15 according to a resonance frequency of the second vibration system so that the vibration generating apparatus itself produces resonance in synchronism with the aforesaid resonance frequency to thereby generate an audible beeping signal, operating as the speaker.

The first vibration system exhibits a lower resonance frequency than the second vibration system because the first plate-like resilient body 9 constituting the first vibration system has a smaller spring constant and the first vibration system has a greater mass due to the inclusion of the magnetic field generating element 7 accounting for most of the mass of the vibration generating apparatus.

In contrast, the second vibration system exhibits a higher resonance frequency because the second plate-like resilient body 10 constituting the second vibration system has a greater spring constant and the second vibration system has a smaller mass due to the inclusion of only the coil 14 with a small mass and the second plate-like resilient body 10.

The resonance aperture 8C defined in the frame body 8 provides an even greater level of the audible beeping signal by virtue of the resonant effect, which audible beeping signal is produced by the resonance of the second plate-like resilient body 10. This allows a sufficient signal sound to be attained with a low energy. More specifically, the following theoretical expression of Helmholtz and experimental results suggest that an appropriate sectional area of the resonance aperture 8*c* be in the range of 0.1 to 4 $mm^2$.

The theoretical expression of Helmholtz expresses the frequency "f" as follows:

$$S=V\cdot L\cdot(2\pi f)^2/C^2$$

wherein "S" denotes a sectional area of the resonance aperture 8*c*, "V" denotes a volume of the frame body 8, "L" denotes a distance in the resonance aperture 8*c* spanning the outer circumferential surface and the inner circumferential surface of the frame body 8, and "c" denotes the velocity of sound in the air.

It is preferred to set the respective resonance frequencies of the first and second vibration systems such that the frequency of the body-sensible vibration produced by the first vibration system is 250 Hz or less and the frequency of the beeps produced by the second vibration system is 600 Hz or more. The frequency of the second vibration system is set to a level of not smaller than 600 Hz because the loudness curve of ISO226 (1961) or the like indicates that the vibration at 600 Hz or more produces an audible sound at a low sound pressure level. That is, a low vibration energy can produce such a sound that can be perceived by human. The frequency of the first vibration system is set to a level of not greater than 250 Hz because the loudness curve or the like indicates that the vibration at 250 Hz or less produces such a sound that cannot be perceived by human. As a result, only the mechanical vibration may be transferred.

In this manner, a single body of the vibration generating apparatus is capable of generating two kinds of call signals including beeps and body-sensible vibration. Hence, incorporating the vibration generating apparatus of the invention into portable devices may eliminate the need for incorporating two elements of the speaker 2 and pager motor 3 which are employed by the prior art. This contributes to a reduced weight and number of components of the portable device.

The aforementioned vibration generating apparatus is applicable to portable devices such as a pager, wrist watch and the like, as incorporated therein. Then, for example, such a portable device is adapted to allow the pager carrier to select either the audible beeping signal or the body-sensible vibration by way of a switch. Alternatively, the portable device may have an arrangement such that the aforesaid CPU 17 causes the pulse signal of the first frequency and the pulse signal of the second frequency to alternate at regular time intervals whereby the audible beeping signal and the body-sensible vibration are alternately generated.

The magnetic field generating element 13 of the aforementioned construction suffers less leakage of magnetic flux than a construction wherein the magnet is disposed at the center of the yoke. In addition, such a construction allows for a short coil type coil 14, thus offering merits in terms of magnetic efficiency and downsizing.

Second Mode of the Invention

Figure 4:
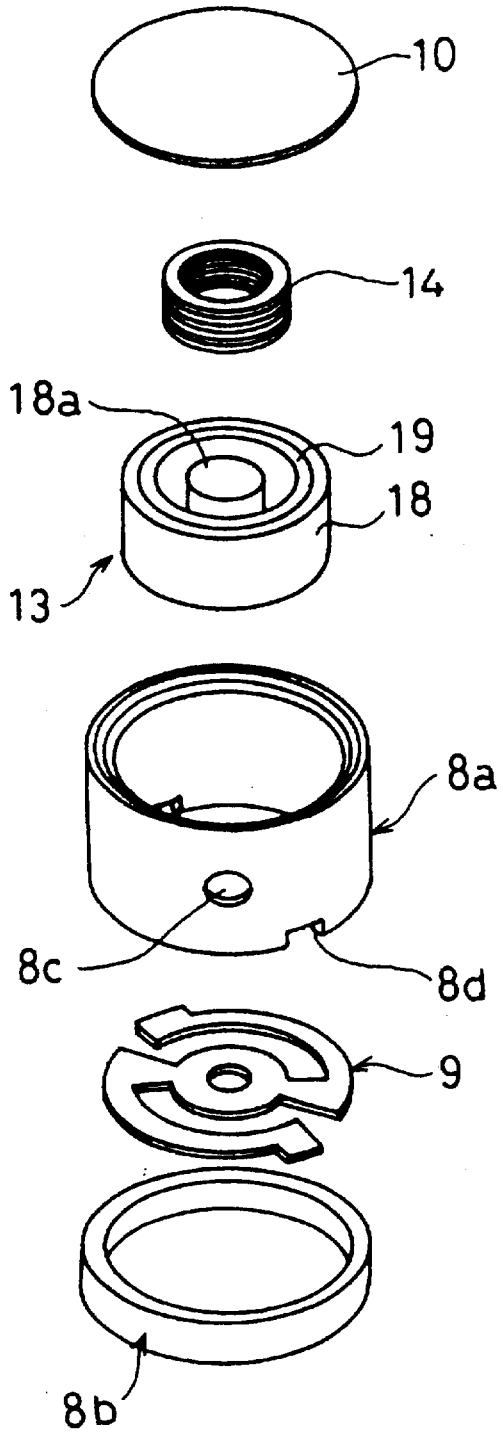
FIG. 4 is an exploded perspective view of a vibration generating apparatus according to the invention (second mode hereof)

FIG. 4 illustrates a vibration generating apparatus according to a second mode hereof.

As to the magnetic field generating element 13 of the first vibration system according to the first mode hereof, a metal sheet is stamped into a cross shape, the four sides of which are bent upward to form the yoke 11 including the base portion 11*a*, four outer peripheral portions 11*c* and the like while the coil 14 is shaped like a square cylinder to correspond to the shape of the yoke 11. According to the second mode hereof, the magnetic field generating element 13 comprises a pot-type yoke 18 shaped like a round pot and an annular magnet 19 attached to the interior side of the pot-shaped yoke 18 while the coil 14 is wound in the form of cylinder. The magnet 19 is so magnetized as to have the N-pole on the outer circumferential side thereof and the S-pole on the inner circumferential side. Indicated at 18*a* is a center pole of the yoke 18. The construction of the other portions is the same as that of the first mode of the invention.

The above construction may attain a similar effect to that of the first mode hereof and also prevent the occurrence of unstable vibration caused by mass unbalance in the first vibration system.

Third Mode of the Invention

Figure 5:
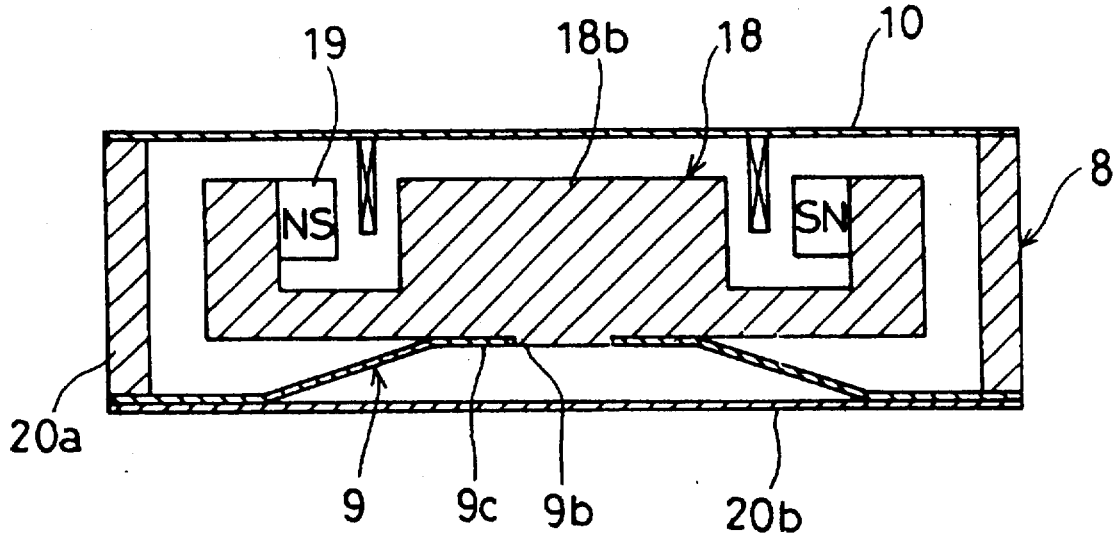
FIG. 5 is a sectional view of a vibration generating apparatus according to the invention (third mode hereof)
Figure 6:
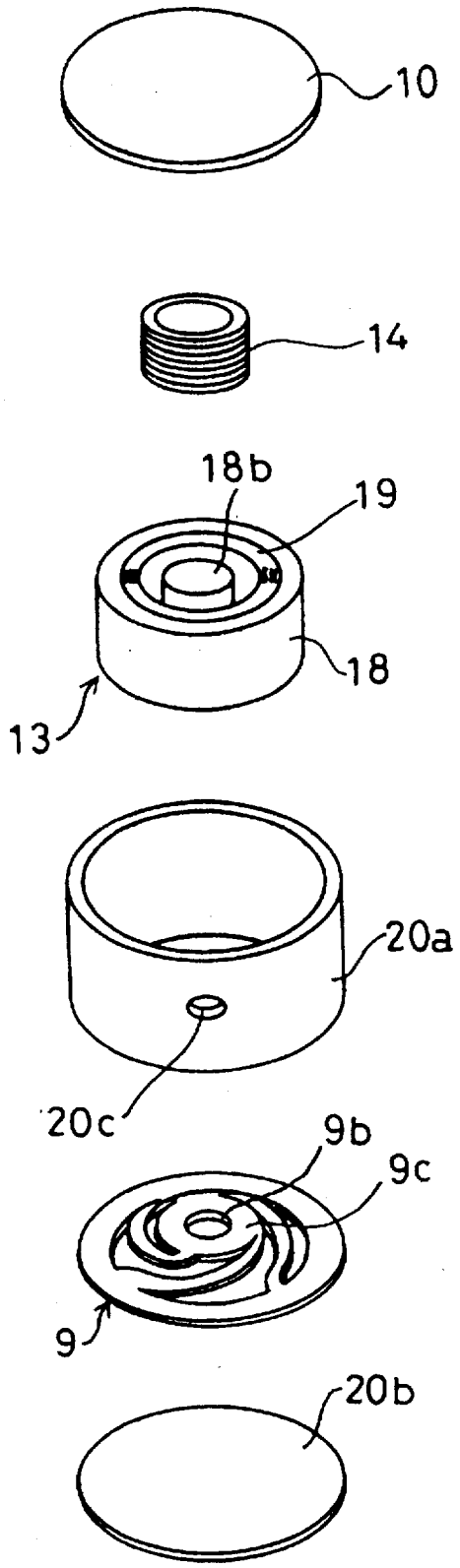
FIG. 6 is an exploded perspective view of the above mode.

FIGS. 5 and 6 illustrate a vibration generating apparatus according to a third mode hereof.

The first plate-like resilient body 9 of the first mode hereof is shaped like a flat plate. On the other hand, the first resilient body 9 of the third mode has a planar form of volute and a sectional form of hat with a central portion 9*c* thereof raised. Formed at the central portion 9*c* thereof is a mounting hole 9*b*. The first resilient body 9 has an outer diameter portion thereof sandwiched between an upper cylinder body 20*a* and a plate-like bottom cover 20*b*. A resonance aperture is indicated at 20*c*.

Such a construction may also attain a similar effect to that of the second mode hereof.

Fourth Mode of the Invention

Figure 7:
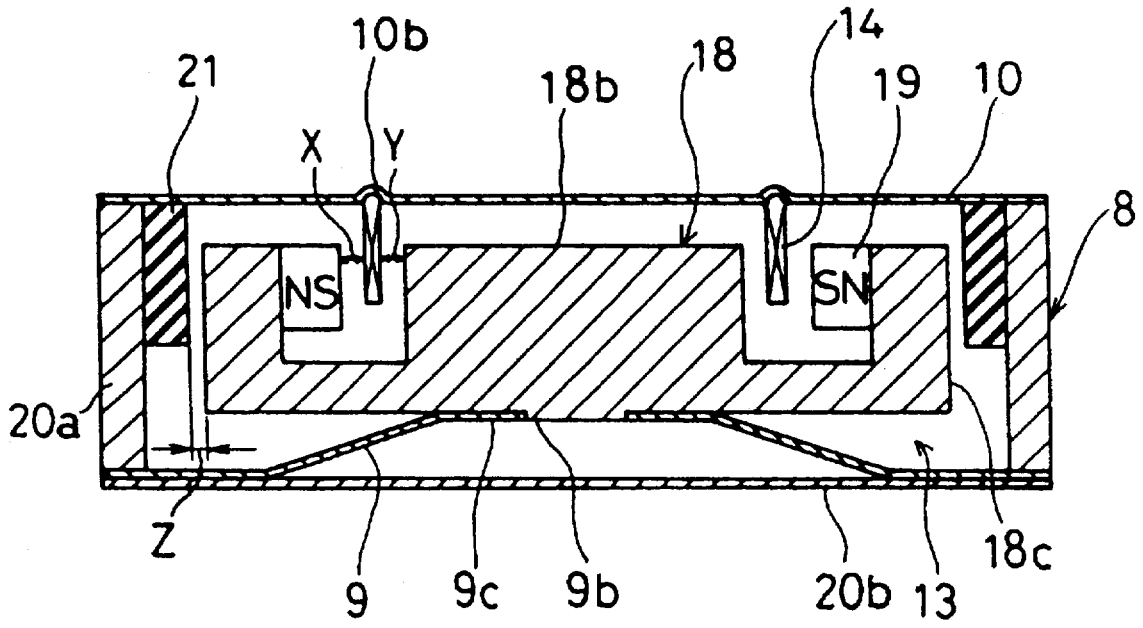
FIG. 7 is a sectional view of a vibration generating apparatus according to the invention (fourth mode hereof)
Figure 8:
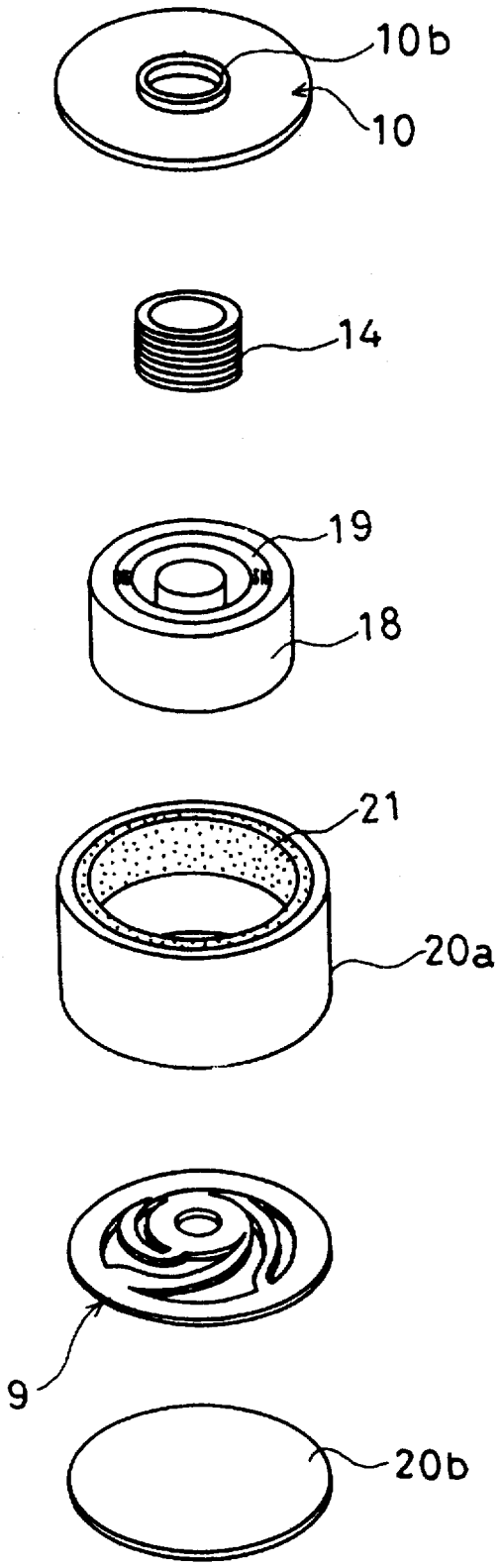
FIG. 8 is an exploded perspective view of the above mode.

FIGS. 7 and 8 illustrate a vibration generating apparatus according to a fourth mode hereof.

The third mode hereof includes nothing in space between the upper cylinder body 20*a* and the outer peripheral portions of the yoke 18. In the fourth mode hereof, however, an annular soft resilient body 21 such as formed of a rubber material is secured to the upper end portion of the inner circumference of the upper cylinder body 20*a*.

The second plate-like resilient body 10 is formed with an annular groove 10*b* at the center thereof for easy positioning of the coil 14, which is mounted to the annular groove 10*b*.

The arrangement is made such that a distance "X" between the coil 14 mounted to the second plate-like resilient body 10 and the magnet 19, and a distance "Y" between a center pole 18*b* of the yoke 18 and the coil 14 are both greater than a distance "Z" between the soft resilient body 21 and the outer peripheral portions 18*c* of the yoke 18.

In the vibration generating apparatus of this construction, the CPU 10 of FIG. 3 is adapted to drive the coil 14 either at the first frequency for bringing the first vibration system into resonance or at the second frequency for bringing the second vibration system into resonance. Thus, when driven at the first frequency, the vibration generating apparatus generates the body-sensible vibration as the inaudible call signal without annoying people nearby. When driven at the second frequency, the apparatus generates the audible beeping signal, operating as the speaker.

More specifically, the resonance frequency of the first plate-like resilient body 9 with the magnetic field generating element 13 mounted thereto is set to 50 to 150 Hz, while the resonance frequency of the second plate-like resilient body 10 is set to 2 to 3 KHz. For example, a current at a specified frequency of not greater than 250 Hz as the first frequency is applied to the coil 14 to thereby bring the first plate-like resilient body 9 into resonance for producing the body-sensible vibration. On the other hand, a current at a specified frequency of not smaller than 600 Hz as the second frequency, for example, is applied to the coil 14 to thereby bring the second plate-like resilient body 10 into resonance for producing the audible beeping signal.

The annular magnetic field generating element 13 comprised of the annular yoke 18 and magnet 19 suffers less leakage of magnetic flux than the construction wherein the magnet is disposed at the center of the yoke. This offers an advantage of enhancing the magnetic efficiency and downsizing the apparatus. In addition, the annular magnetic field generating element 13 and coil 14 may prevent an unstable vibration due to mass unbalance in the first vibration system and also, contributes to a further increased productivity.

The provision of the annular soft resilient body 21 allows the self-oscillation of the yoke 18 to be accommodated regardless of the orientation of the vibration generating apparatus or even if the apparatus is subject to a drop impact. This prevents the occurrence of abnormal sound caused by the yoke 18 coming into contact with the inner circumferential surface of the frame body 8. It is preferred to use a rubber type sealing material or the like for the soft resilient body 21.

Fifth Mode of the Invention

Figure 9:
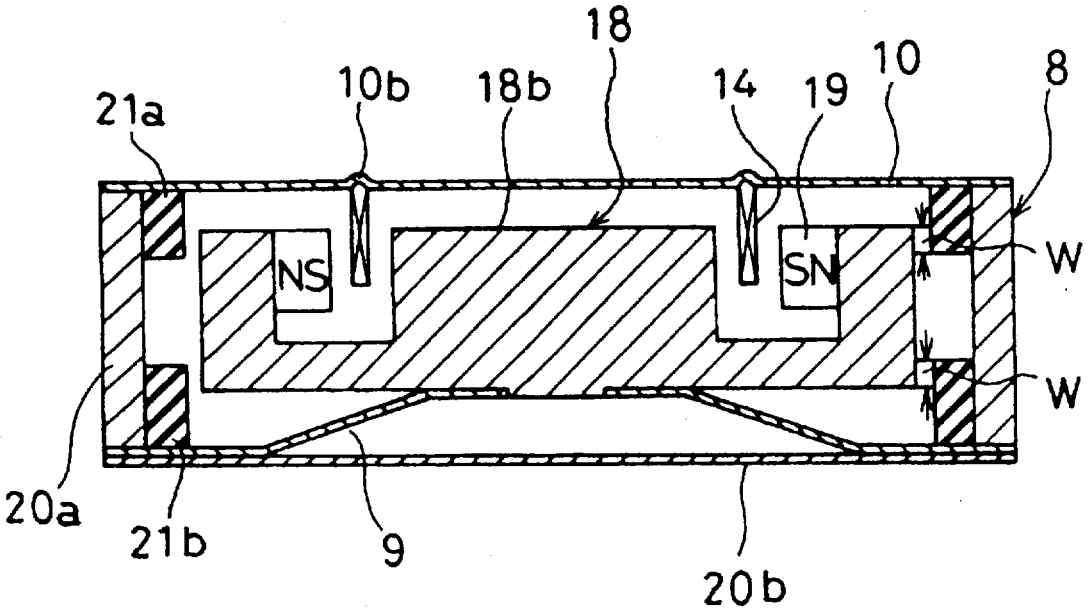
FIG. 9 is a sectional view of a vibration generating apparatus according to the invention (fifth mode hereof)

FIG. 9 illustrates a fifth mode of the invention.

In the fourth mode hereof, the annular soft resilient body 21 is disposed on the inner circumference of the upper cylinder body 20*a*. In the fifth mode hereof, however, soft resilient bodies 21*a* and 21*b* are provided on the first and second plate-like resilient bodies 9 and 10, respectively, as shown in FIG. 9. The soft resilient bodies 21*a* and 21*b* has lengths including an overlapping portion W for respectively overlapping the upper and lower end portions of the yoke 18 such that the vibration of the yoke 18 may be restricted to one direction without being attenuated. This can prevent the occurrence of abnormal sound.

Sixth Mode of the Invention

FIG. 10 illustrates a sixth mode hereof.

Figure 10A:
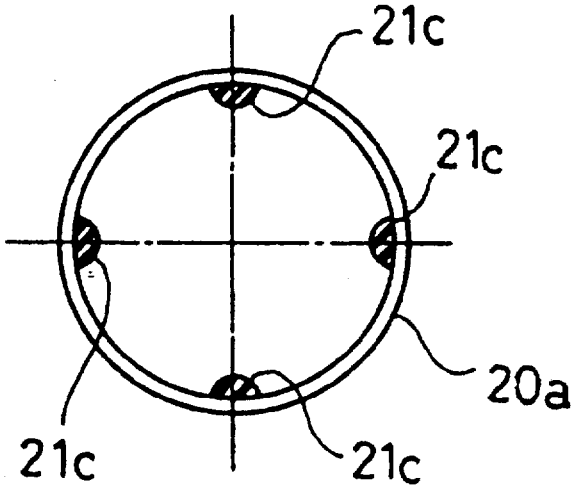
FIGS. 10(*a*) and (*b*) includes a plan view and a perspective view of a principal portion of the invention (sixth mode hereof)
Figure 10B:
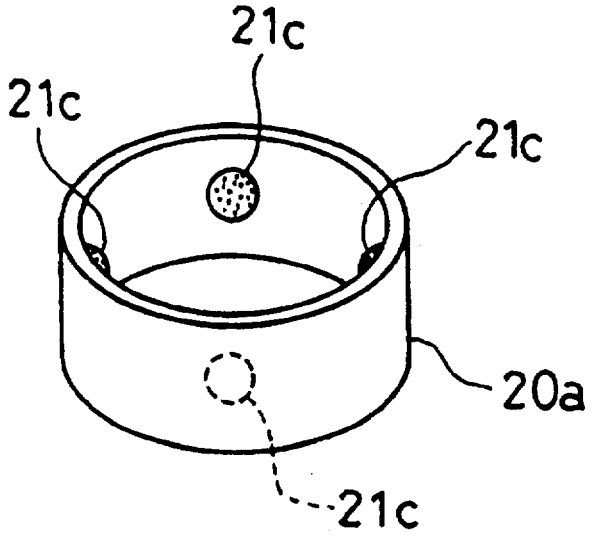

In the fourth mode hereof, the annular soft resilient body 21 is provided on the inner circumference of the upper cylinder body 20*a*. Alternatively, the sixth mode hereof may employs semispherical projections 21*c*, as shown in FIGS. 10*a* and 10*b*. With these separate projections such as formed of a resin material or the like, the yoke 18 suffers less attenuation of the vibration thereof as compared to the case of the annular soft resilient body. Such a construction further offers an advantage of easy fabrication.

Seventh Mode of the Invention

Figure 11A:
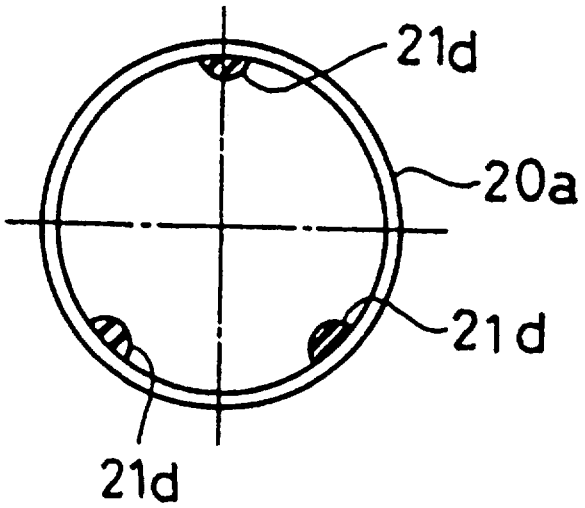
FIGS. 11(*a*) and (*b*) includes a plan view and a perspective view of a principal portion of the invention (seventh mode hereof)
Figure 11B:
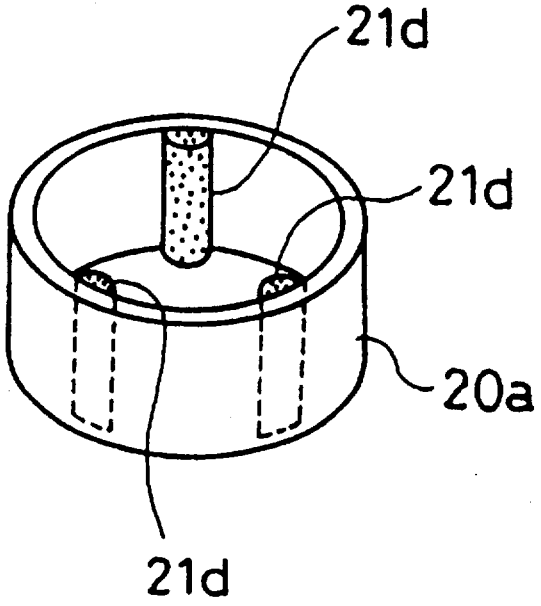

FIG. 11 illustrates a seventh mode hereof. In the fourth mode hereof, the annular soft resilient body 21 is provided on the inner circumference of the upper cylinder body 20*a*. Alternatively, the seventh mode hereof may include stick-like vertical projections 21*d* disposed on the inner circumference of the upper cylinder body as spaced from each other, as shown in FIGS. 11*a* and 11*b*. With such projections formed of a resin material or the like and spaced from each other, the yoke 18 suffers less attenuation of the vibration thereof as compared with the case of the annular soft resilient body. The construction further offers an advantage of easy fabrication.

Eighth Mode of the Invention

Figure 12:
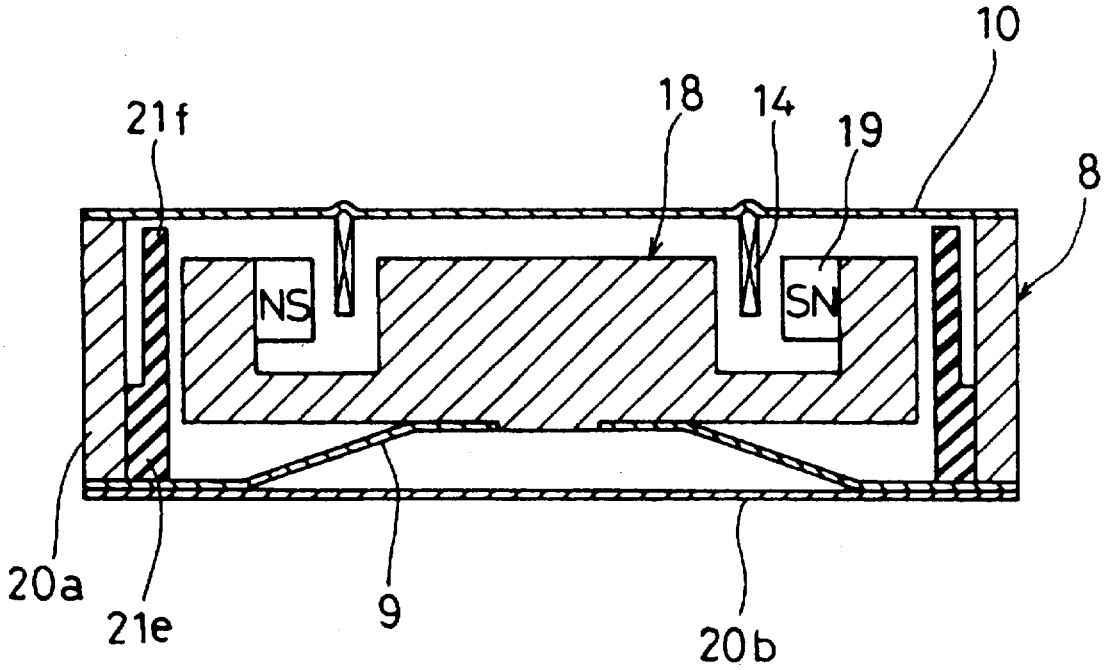
FIG. 12 is a sectional view of a vibration generating apparatus according to the invention (eighth mode hereof)

FIG. 12 illustrates an eighth mode hereof.

In the fourth mode hereof, the annular soft resilient body 21 is provided on the inner circumference of the upper cylinder body 20*a*. In the eighth mode hereof, the soft resilient body 21*e* may have a free end portion 21*f*, as shown in FIG. 12. In this case, the soft resilient body may have an annular shape or may be disposed on the circumference as spaced from each other. The provision of the free end portion 21*f* allows the vibration of the yoke 18 to be more flexibly accommodated, thus preventing the vibration thereof from being attenuated while restricting the vibration thereof to one direction.

Ninth Mode of the Invention

Figure 13:
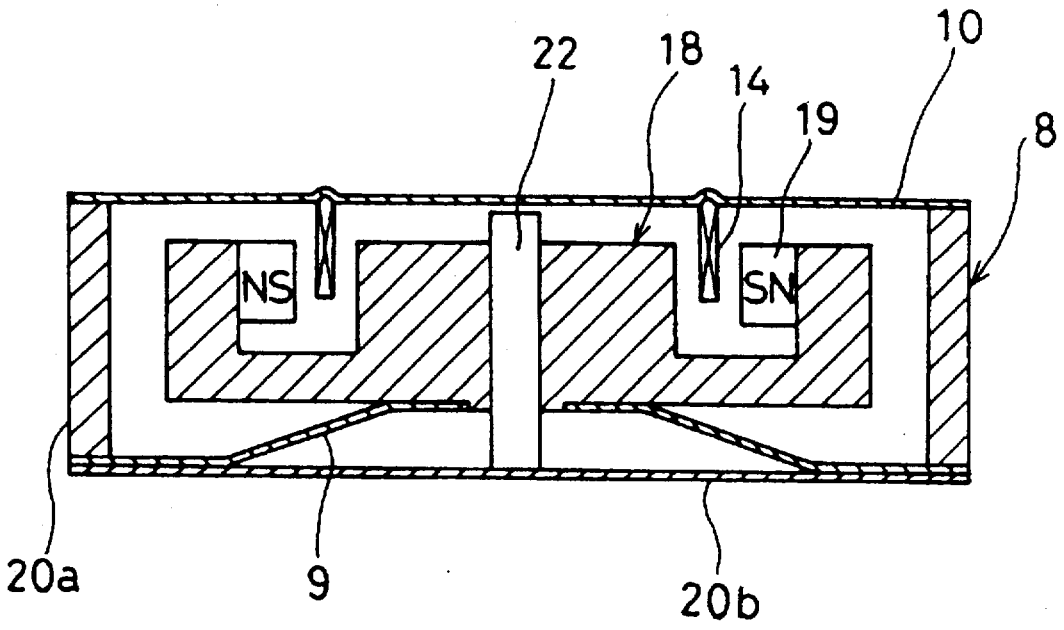
FIG. 13 is a sectional view of a vibration generating apparatus according to the invention (ninth mode hereof)

FIG. 13 illustrates a ninth mode hereof, which further includes a guide shaft 22 extending through the center of the yoke 18. The guide shaft 22 has a base portion thereof secured to the bottom cover 20*b* of the frame body 8 whereby the yoke 18 vertically movable as carried on the first plate-like resilient body 9 is allowed to vibrate along the guide shaft 22. The construction of the other portions is the same with the fourth mode hereof.

This construction allows the yoke 18 to always vibrate in one direction regardless of the orientation of the vibration generating apparatus or even if the apparatus is subject to a drop impact. Thus is prevented the occurrence of abnormal sound caused by the yoke 18 coming into contact with the inner circumferential surface of the frame body 8.

Tenth Mode of the Invention

Figure 14:
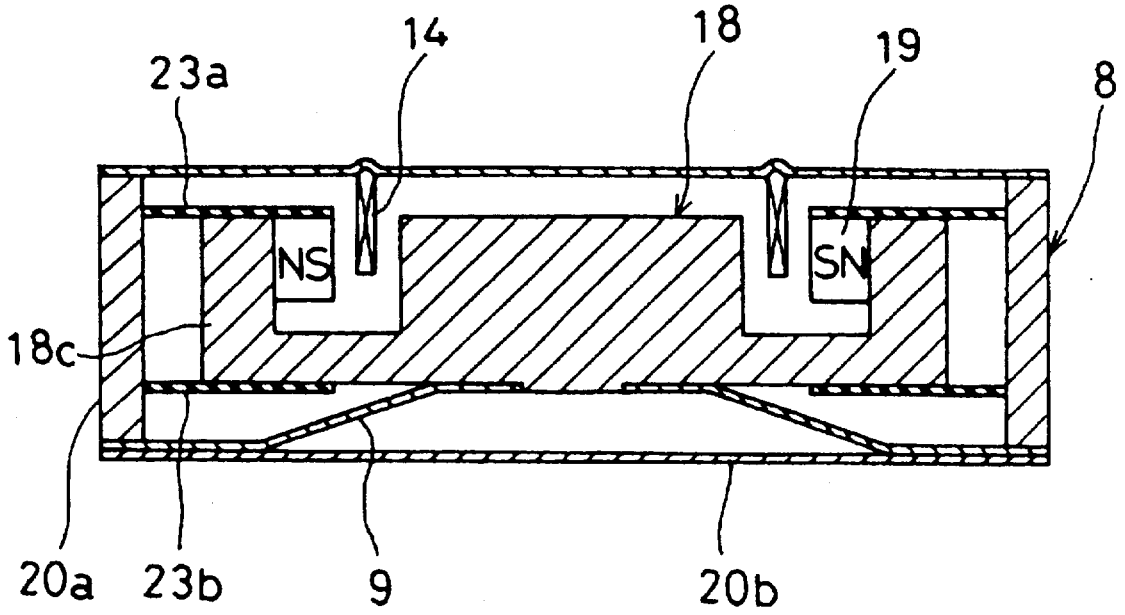
FIG. 14 is a sectional view of a vibration generating apparatus according to the invention (tenth mode hereof)

FIG. 14 illustrates a tenth mode hereof, wherein the outer peripheral portion of the yoke 18 has the top surface and bottom surfaces thereof coupled to the inner circumferential surface of the frame body 8, respectively, by means of resilient supports 23*a* and 23*b* having resilience and a ring-like shape.

With this construction, the yoke 18 vertically movable as carried on the first plate-like resilient body 9 is brought into vibration, the direction of which is restricted by the resilient supports 23*a* and 23*b*. The construction of the other portions is the same with the fourth mode hereof.

Hence, the yoke 18 is adapted to vibrate always in one direction regardless of the orientation of the vibration generating apparatus or even if the apparatus is subject to a drop impact. This prevents the occurrence of abnormal sound caused by the yoke 18 coming into contact with the inner circumferential surface of the frame body 8.

Further, it is possible to do without the first plate-like resilient body 9 by making the resilient: support 23*b* to function also as said resilient body 9.

Eleventh Mode of the Invention

Figure 15:
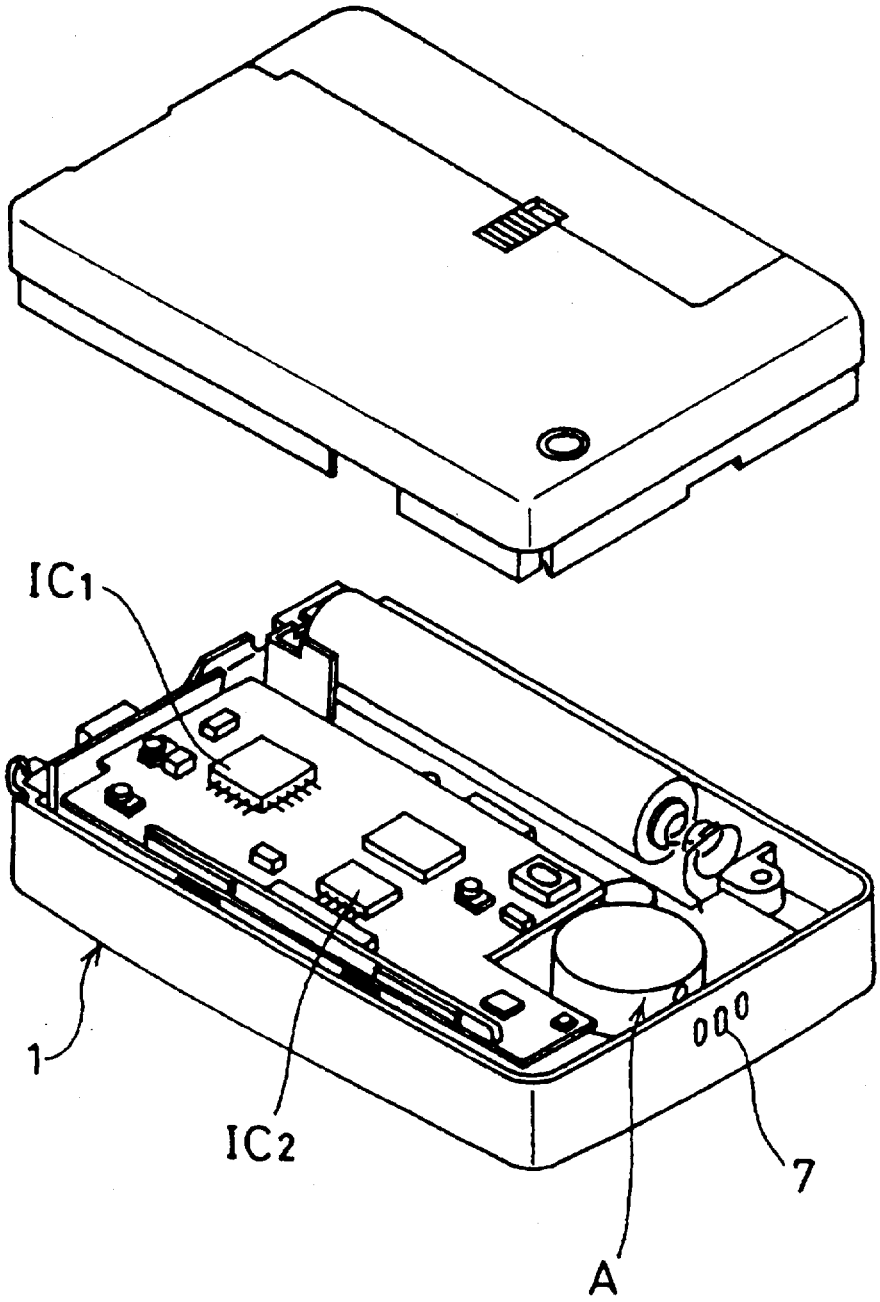
FIG. 15 is an exploded perspective view showing a state where a vibration generating apparatus of the invention is incorporated in a portable device.

FIG. 15 illustrates an eleventh mode hereof. The figure shows a state wherein a vibration generating apparatus A (of the fourth mode hereof) is installed within a casing 1 of a pager in a similar manner to the case of any one of the aforesaid modes hereof.

Figure 16:
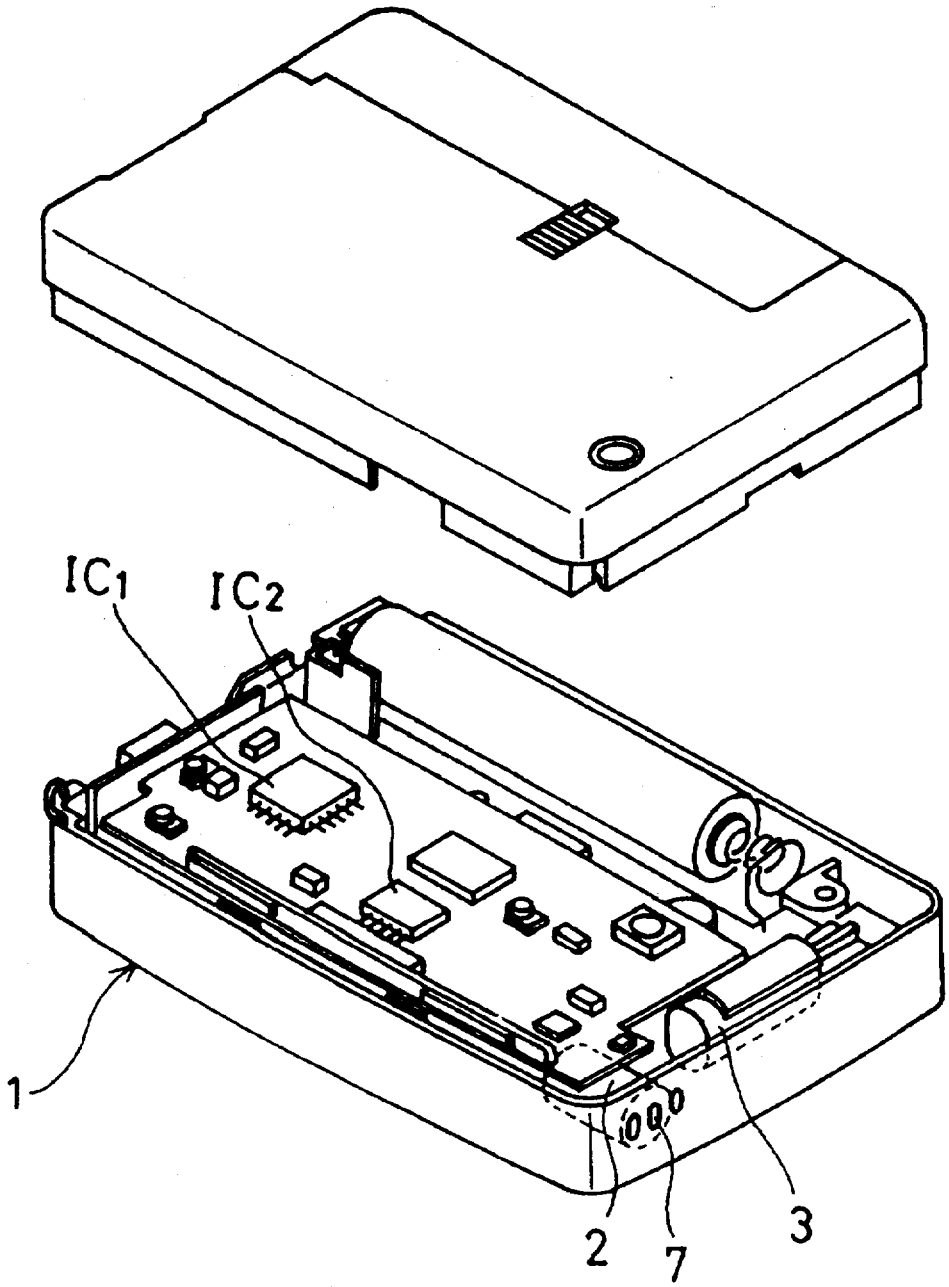
FIG. 16 PRIOR ART
FIG. 16 is an exploded perspective view of a prior art portable device.
Figure 17:
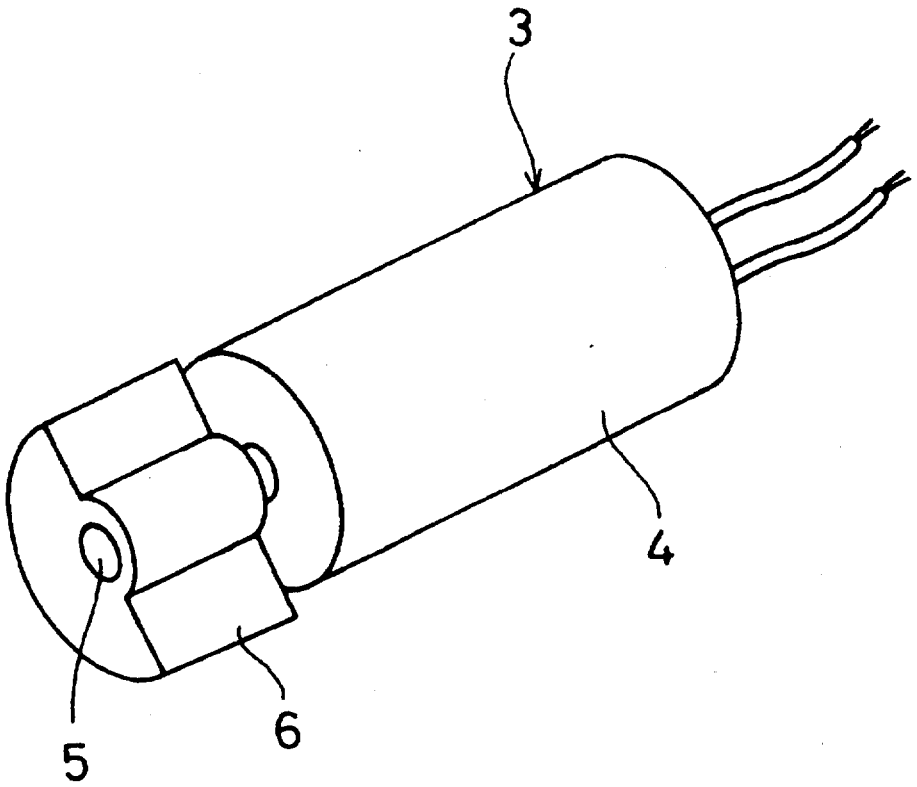
FIG. 17 PRIOR ART
FIG. 17 is an enlarged perspective view of a pager motor as a prior art vibration generating apparatus.

Mounting the vibration generating apparatus of the invention allows the receipt of a call signal to be selectively informed by way of sound or vibration, thus eliminating the need for incorporating the speaker 2 which is employed by the prior art shown in FIG. 16.

Here, a vibration generating force produced by the prior art arrangement shown in FIG. 16 was compared with that of a vibration generating apparatus of the invention (the eighth mode hereof) shown in FIG. 12 which is installed within the casing 1 of the pager.

In the conventional pager motor 3 for use in the pager, the coreless motor 4 had a diameter of 6.0 mmϕ and a length of 14.5 mm, the weight 6 had a diameter of 6.0 mmϕ, a length of 4.5 mm and a weight of 1.2 g; the vibration produced by the rotating shaft rotated at the speed of 7500 rpm exhibited the frequency of 125 Hz. At this time, the vibration generating force caused by the centrifugal force was 0.95N.

On the other hand, the whole body of the vibration generating apparatus A of FIG. 12 had an outer diameter of 17 mmϕ and a height of 6.2 mm, the soft resilient bodies 21 were mounted to three places as shown in FIG. 11, the yoke 18 was formed of Permally and 4.3 g in weight, and the first plate-like resilient body 9 was formed of stainless steel and 0.1 mm in thickness. When the coil 14 was driven at the frequency of 70 Hz, the vibration generating force was 1.00N.

As apparent from this comparison, the vibration generating apparatus A produces as much vibration generating force as the pager motor 3. Since the vibration generating apparatus A is brought into vibration at a lower frequency than the pager motor 3, the vibration generating apparatus causes a greater displacement of the casing 1 of the pager during vibration. This allows the call signal by way of vibration to be more readily perceived by the pager carrier.

The comparison of the vibration generating apparatus A and the speaker 2 was made on the characteristic of the audible beeping signal. The speaker 2 of FIG. 16 was 10 mmϕ in diameter and 7 mm in length. The level of sound pressure at the peak frequency as measured at place 10 cm away from the speaker was 85 dB at about 2.7 KHz.

In the case of the vibration generating apparatus A, the level of sound pressure at the peak frequency as measured at place 10 cm away from the second plate-like resilient body 10 was not smaller than 94 dB at about 2.7 KHz. The level of sound pressure at the peak frequency as measured at place 10 cm away from the resonance aperture 8*c* was not smaller than 90 dB at about 2.7 KHz.

What is claimed is:

1. A vibration generating apparatus comprising:

a pair of plate-like resilient bodies opposing each other within a frame body;

one of said plate-like resilient bodies being provided with a magnetic field generating element so as to form a first vibration system;

wherein said magnetic field generating element includes a yoke and a magnet;

wherein said yoke attached to said one of said plate-like resilient bodies, with a center portion and an outer peripheral portion of said yoke being projected toward another plate-like resilient body, and said magnet disposed inside of the outer peripheral portion of said yoke;

wherein said one of said plate-like resilient bodies is formed of a hat-like metal resilient body including a top portion, a bottom portion on the periphery of said top portion, and a connecting portion interconnecting said top and bottom portions; wherein the other of said plate-like resilient bodies being provided with a coil magnetically coupled to a magnetic field generated in said magnetic field generating element so as to form a second vibration system;

wherein said other of said plate-like resilient bodies includes an annular groove to which said coil is fixedly positioned, and said coil being positioned in place between an inner peripheral side of said magnet and an outer circumferential side of the center portion of said yoke; wherein one of said first and second vibration systems has a higher resonance frequency than that of the other vibration system;

one of said first and second vibration systems is selectively brought into vibration in correspondence to a frequency of an exciting current supplied to said coil while the other vibration system generates a sound in correspondence to another frequency;

wherein said one of said plate-like resilient bodies constituting the first vibration system is arranged to vibrate in the direction of the center line of the frame body; and a soft resilient body is disposed on the inner circumferential surface of the frame body as spaced from the outer peripheral portion of the yoke for preventing the occurrence of abnormal sound caused by the yoke coming into contact with the inner circumferential surface of the frame body due to a drop impact.

2. A vibration generating apparatus comprising:

a pair of plate-like resilient bodies opposing each other within a frame body;

one of said plate-like resilient bodies being provided with a magnetic field generating element so as to form a first vibration system;

wherein said magnetic field generating element includes a yoke and a magnet;

wherein said yoke attached to said one of said plate-like resilient bodies, with a center portion and an outer peripheral portion of said yoke being projected toward another plate-like resilient body, and said magnet disposed inside of the outer peripheral portion of said yoke;

wherein said one of said plate-like resilient bodies is formed of a hat-like metal resilient body including a top portion, a bottom portion on the periphery of said top portion, and a connecting portion interconnecting said top and bottom portions; wherein the other of said plate-like resilient bodies being provided with a coil magnetically coupled to a magnetic field generated in said magnetic field generating element so as to form a second vibration system;

wherein said other of said plate-like resilient bodies includes an annular groove to which said coil is fixedly positioned, and said coil being positioned in place between an inner peripheral side of said magnet and an outer circumferential side of the center portion of said yoke; wherein one of said first and second vibration systems has a higher resonance frequency than that of the other vibration system;

one of said first and second vibration systems is selectively brought into vibration in correspondence to a frequency of an exciting current supplied to said coil while the other vibration system generates a sound in correspondence to another frequency;

said first vibration system includes a direction restricting member for restricting the yoke of the first vibration system to vibrate in only one direction, in the vertical center line of the frame body, for preventing the occurrence of abnormal sound caused by the yoke coming into the contact with an inner circumferential surface of the frame body due to a drop impact.

3. A vibration system as set forth in claim 2, wherein said direction restricting member includes a guide shaft which has a base portion thereof secured to the bottom cover of the frame body and then extends through the center portion of said yoke.

4. A vibration system as set forth in claim 2, wherein said direction restricting member includes a pair of plate-like resilient supports, which are provided for carrying top and bottom surfaces of the outer peripheral portion of said yoke on the frame body, respectively.

* * * * *